US006281423B1

(12) United States Patent
Shimizu et al.

(10) Patent No.: US 6,281,423 B1
(45) Date of Patent: Aug. 28, 2001

(54) TONE GENERATION METHOD BASED ON COMBINATION OF WAVE PARTS AND TONE-GENERATING-DATA RECORDING METHOD AND APPARATUS

(75) Inventors: Masahiro Shimizu; Hideo Suzuki, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/662,361

(22) Filed: Sep. 13, 2000

(30) Foreign Application Priority Data

Sep. 27, 1999 (JP) ..... 11-272106

(51) Int. Cl.[7] ..... G10H 1/06; G10H 7/00
(52) U.S. Cl. ..... 84/622; 84/659
(58) Field of Search ..... 84/622, 659, 603, 84/604

(56) References Cited

U.S. PATENT DOCUMENTS 5,532,424 * 7/1996 Hideo ..... 84/622 X
6,046,396 * 4/2000 Miyamoto .
6,150,598 * 11/2000 Suzuki et al. .

FOREIGN PATENT DOCUMENTS 0847 039 6/1998 (EP) .
0856 830 8/1998 (EP) .
10-307587 11/1998 (JP) .

* cited by examiner

*Primary Examiner*—Jeffrey Donels
(74) *Attorney, Agent, or Firm*—Morrison & Foerste

(57) ABSTRACT

Data to be used for generating tone waveform data corresponding to a partial time section of a tone are stored in a basic file or expansion file. In a wave part area of each of the files, there are stored wave part data to be used for generating tone waveform data corresponding to a partial time section of a tone, and the wave part data includes information designating several groups of template data indicative of variations, in the partial time section, of a plurality of tone factors, such as a waveform template, pitch template, amplitude template, spectrum template and time template. Each of the expansion files contains data representative of differences from data stored in the corresponding basic file. The data are stored in such a manner as to avoid overlapping data storage, in order to minimize the total quantity of data.

17 Claims, 6 Drawing Sheets

TONE GENERATION METHOD BASED ON COMBINATION OF WAVE PARTS AND TONE-GENERATING-DATA RECORDING METHOD AND APPARATUS

BACKGROUND OF THE INVENTION

The present invention relates to a tone generation method for generating a tone by generating and interconnecting tone waveform data corresponding to a plurality of partial time sections and a tone-generating-data recording method for generating the tone waveform data, as well as a storage medium having the tone generating data recorded thereon.

Various waveform-memory-based tone generators are known today as tone generators for electronic musical instruments and the like, in which one or more cycles of tone waveform data corresponding to a predetermined tone color are prestored in a memory and a continuous tone waveform is generated by repetitively reading out the prestored waveform data at a readout rate corresponding to a pitch of a tone to be generated. Some of the known waveform-memory-based tone generators are constructed to not only merely read out the memory-stored waveform data for generation of a tone but also process the waveform data in accordance with selected tone color data before outputting them as a tone. For example, regarding the tone pitch, it has been known to modulate the waveform data readout rate in accordance with an optionally-selected pitch envelope to thereby impart a pitch modulation effect such as a vibrato. Regarding the tone volume, it has been known to add an amplitude envelope based on a given envelope waveform to the read-out waveform data or periodically modulate the tone volume amplitude of the read-out waveform data to thereby impart a tremolo effect or the like. Regarding the tone color, it has been known to perform a filtering process on the read-out waveform data for appropriate tone color control.

Further, as one example of the waveform-memory-based tone generators, there has been known the sampler which is constructed to form a tone using waveform data recorded by a user or supplied by a maker of the tone generator.

Also known is the digital recorder which collectively samples successive tones (i.e., a phrase) actually performed live and records the sampled tones or phrase into a single recording track and which then reproduces individual phase waveforms thus-pasted to a plurality of the tracks.

Furthermore, as a tone recording scheme for CD (Compact Disk) recording, it has been well known to record, in PCM data, all tone waveform data of a single music piece actually performed live.

Generally, in the above-mentioned waveform-memory-based tone generators, waveform data covering an attack portion through a release portion of a tone or attack and loop portions of a tone are stored in a waveform memory. Thus, in order to realize a great number of tone colors, it has been absolutely necessary to store a multiplicity of waveform data and it has been very difficult, if not impossible, to generate tones corresponding to various styles of rendition (performing techniques) employed by a human player.

Further, with such a sampler where no waveform data of a desired tone color are not stored in the memory, it has been necessary to either newly record such waveform data or acquire the waveform data from a CD or the like.

Furthermore, with the above-mentioned digital recorder storing the waveform data of all samples, there has been a need for a large-capacity storage medium.

SUMMARY OF THE INVENTION

To provide solutions to the above-discussed problems and inconveniences, the inventors of the present invention have developed an interactive high-quality tone making technique which, in generating tones using an electronic musical instrument or other electronic apparatus, achieves realistic reproduction of articulation and also permits free tone creating and editing operations by a user. The inventors of the present invention also have developed a technique which, in waveform generation based on such an interactive high-quality tone making technique, can smoothly interconnect waveform generating data corresponding to adjoining partial time sections of a desired tone. It should be understood that the term "articulation" is used herein to embrace concepts such as a "syllable", "connection between tones", "group of a plurality of tones (i.e., phrase)", "partial characteristics of a tone", "style of tone generation (or sounding)", "style of rendition (i.e., performing technique)" and "performance expression" and that in performance of a musical instrument, such "articulation" generally appears as a reflection of the "style of rendition" and "performance expression" employed by a human player. Such tone data making and tone synthesizing techniques are designed to analyze articulation of tones, carry out tone editing and tone synthesizing processes using each articulation element as a basic processing unit, and thereby execute tone synthesis by modeling the tone articulation. This technique is also referred to as SAEM (Sound Articulation Element Modeling).

The SAEM technique, which uses basic data obtained by analyzing and extracting tone waveforms of partial time sections in correspondence with various tone factors, such as tone color, volume and pitch, can change or replace, as necessary, the basic data corresponding to the individual tone factors in each of the partial time sections and also can smoothly connect the waveforms of adjoining partial time sections. Thus, the SAEM technique permits creation of articulation-containing tone waveforms with good controllability and editability.

However, there has been a strong demand for minimization of a necessary storage capacity of storage means for storing the basic data and other tone-waveform generating data.

In view of the foregoing, it is an object of the present invention to provide a tone generation method which, in an application where a desired tone color is produced by combining tone waveforms of a plurality of partial time sections, can generate tones of an increased number of tone colors with a reduced quantity of data and a tone-generating-data recording method, as well as a storage medium having tone generating data recorded thereon.

In relation to the above object, the present invention also seeks to provide a data editing technique which affords an improved convenience of use in various applications.

In order to accomplish the above-mentioned objects, the present invention provides a tone generation method for generating tone waveform data on the basis of given performance information, which comprises: a step of selecting wave part data suiting the given performance information from among wave part data that are to be used for generating tone waveform data corresponding to a partial time section of a tone, the wave part data designating a combination of template data indicative of respective variations of a plurality of tone factors in the partial time section; and a step of using the selected wave part data to generate tone waveform data corresponding to the partial time section of the tone, the tone waveform data corresponding to the partial time section of the tone being generated on the basis of respective template data for the plurality of tone factors contained in the wave part data.

According to another aspect of the present invention, there is provided a management method for use in a system for generating tone waveform data, which comprises a step of introducing a tone generating data file into the system for generation of tone waveform data, the tone generating data file being at least one of first-type and second-type tone generating data files. Here, the first-type tone generating data file includes: wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section. The second-type tone generating data file includes: the above-mentioned wave part data; information instructing that template data present in a predetermined other tone generating data file should be used for at least one template data of the set of the template data designated by the wave part data; and the remaining template data of the set of the template data designated by the wave part data. The management method of the invention further comprises a step of, when the second-type tone generating data file is introduced into the system by the introducing step, determining whether or not the predetermined other tone generating data file is already introduced in the system; and a step of issuing a predetermined warning when it has been determined that the predetermined other tone generating data file is not yet introduced in the system.

According to still another aspect of the present invention, there is provided a management method for use in a system for generating tone waveform data, which comprises: a step of canceling, from the system, a tone generating data file having been present so far in the system for use for tone waveform data generation, the tone generating data file being at least one of first-type and second-type tone generating data files; the first-type tone generating data file including: wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section, the second-type tone generating data file including: the above-mentioned wave part data; information instructing that template data present in a predetermined other tone generating data file should be used for at least one template data of the set of the template data designated by the wave part data; and the remaining template data of the set of the template data designated by the wave part data; a step of determining whether or not the tone generating data file to be canceled by the canceling step is the predetermined other tone generating data file to be used by the second-type tone generating data file and the second-type tone generating data file using the predetermined other tone generating data file is already introduced in the system; and a step of issuing a predetermined warning prior to cancellation of the tone generating data file from the system, when an affirmative determination has been made in the step of determining.

According to still another aspect of the present invention, there is provided a method for storing tone generating data, in which the tone generating data comprises a tone generating data file that includes wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section. The method of the invention comprises: a step of editing template data of an already-existing tone generating data file and creating new wave part data based on the already-existing tone generating data file; and a step of storing the new wave part data and template data created and edited by the editing step as a new tone generating data file distinct from the already-existing tone generating data file.

According to still another aspect of the present invention, there is provided a method for storing tone generating data wherein the tone generating data comprises a tone generating data file that includes wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section, the method of the invention comprising: a step of creating new template data; a step of determining whether or not template data similar to the new template data created by the creating step is present in any already-existing tone generating data file; and a step of, when it has been determined that template data similar to the new template data is present in an already-existing tone generating data file, performing control to store information instructing that the template data similar to the new template data present in the already-existing tone generating data file should be used in place of the new template data, without storing the new template data as created.

In the above-mentioned method, the step of creating new template data creates new template data by editing template data of an already-existing tone generating data file.

The present invention may be constructed and implemented not only as the method invention as discussed above but also as an apparatus invention. Also, the present invention may be arranged and implemented as a software program for execution by a processor such as a computer or DSP, as well as a storage medium storing such a program. Further, the present invention may be implemented as a machine-readable storage medium storing tone waveform data based on the principles of the invention. Furthermore, the processor used in the present invention may comprise a dedicated processor based on predetermined fixed hardware circuitry, rather than a CPU or other general-purpose type processor capable of operating by software.

BRIEF DESCRIPTION OF THE DRAWINGS

For better understanding of the objects and other features of the present invention, its preferred embodiments will be described in greater detail hereinbelow with reference to the accompanying drawings, in which.

DETAILED DESCRIPTION OF THE PREFERRED EMBODIMENTS

Figure 1:
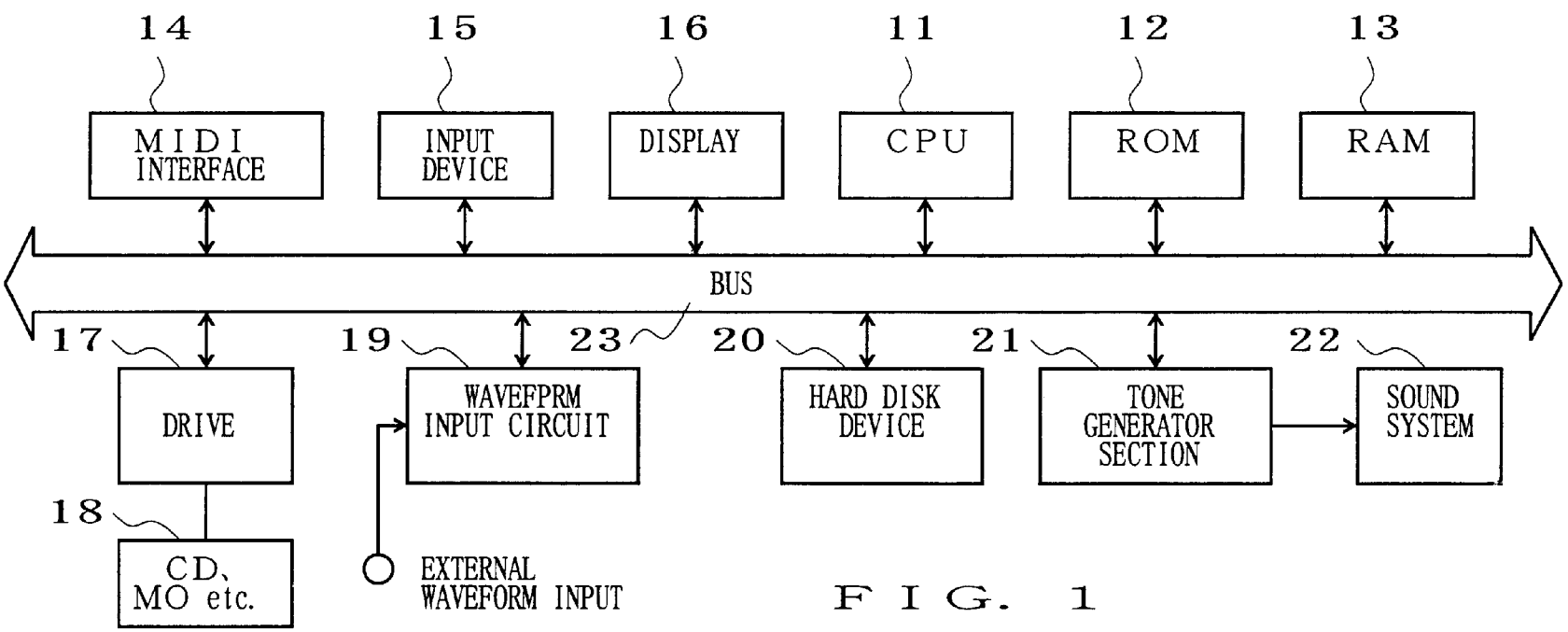
FIG. 1 is a block diagram showing an exemplary general hardware setup of an embodiment of a tone generation apparatus to which the present invention is applied.

FIG. 1 is a block diagram showing an exemplary general hardware setup of an embodiment of a tone generation apparatus to which the basic principles of the present invention are applied. In FIG. 1, the tone generation apparatus includes a central processing unit (CPU) 11 for controlling behavior of the apparatus, a ROM 12 storing various control programs and data, a RAM 13 for use as areas storing waveform data and various other data and as a working area, a MIDI interface circuit 14 for communicating MIDI signals between the apparatus and external MIDI equipment such as a sequencer, electronic musical instrument, MIDI keyboard or personal computer equipped with performance sequence software. The tone generation apparatus of FIG. 1 also includes an input device 15 that is in the form of a character-inputting keyboard and a pointing device such as a mouse or track ball, a graphic display device 16, a drive circuit 17 for driving a large-capacity storage medium 18 such as a compact disk (CD-ROM) or magneto-optical (MO) disk, and a waveform input circuit 19 that receives analog waveform signals from a microphone or audio equipment, converts the received analog waveform signals into digital waveform data at a predetermined sampling frequency and then stores the converted waveform data into the RAM 13 or hard disk device 20. Further, in the tone generation apparatus, there is provided a tone generator (T.G.) section 21 that uses the above-mentioned RAM 13 or hard disk device 20 as a waveform memory and, in response to an instruction from the CPU 11, simultaneously generates, on a time-divisional basis, a plurality of tone waveform data based on the waveform data stored in the waveform memory. The tone generator section 21 is capable of imparting designated effects to the tone waveform data and mixing the effect-imparted tone waveform data to thereby output the mixture of the tone waveform data. Further, reference numeral 22 represents a sound system that converts the tone waveform data output from the tone generator section 21 into analog signals and amplifies and outputs the analog signals for audible reproduction or sounding. Furthermore, reference numeral 23 represents a bus to be used for data transfer between the above-mentioned various components of the tone generation apparatus.

It should be appreciated that the tone generation apparatus of the present invention may be implemented, for example, by a personal computer having the function of sampling and recording waveform data and a waveform-memory-based tone generator, and that the tone generator section 21 may be implemented by a so-called software tone generator capable of generating tones by software.

In the thus-constructed tone generation apparatus, the CPU 11 carries out processing to automatically perform music piece data on the basis of automatic performance software such as performance sequence software. As the music piece data (i.e., performance information), a standard MIDI file (SMF) may be employed in the tone generation apparatus. The standard MIDI file includes a plurality of tracks capable of being controlled in tone color and tone volume independently of each other, and combinations of MIDI information (MIDI events) to be sequentially generated or reproduced and respective generation timing (duration data) of the individual MIDI events are stored for each of the tracks. In the automatic performance processing, the CPU 11 generates MIDI events at timing designated by the duration data.

On the basis of tone generator driver software, the CPU 11 performs tone generator control processing corresponding to the MIDI events and sends control parameters to the tone generator section 21. For example, the CPU 11 executes the following operations when a note-on event occurs:

(1) taking the note-on event into a buffer;

(2) assigning one of a plurality of tone generating channels of the tone generator section 21 to tone generation corresponding to the note-on event to;

(3) setting, into a register of the assigned tone generating channel of the tone generator section 21, control data to control the tone generation corresponding to the note-on event; and (4) instructing note-on to the register of the assigned tone generating channel so that the tone generator section 21 starts generating a tone in that channel. In this way, a tone corresponding to the MIDI signal can be generated.

In the present invention, a tone waveform is formed by joining together partial tone waveforms (hereinafter referred to as "wave parts") corresponding to partial time sections of a tone, in a similar manner to the above-described SAEM (Sound Articulation Element Modeling) technique. Each of the wave parts comprises a combination of a plurality of basic data (template data) classified according to the tone factors. Each of the template data is representative of a variation, over time, of one of various tone factors in the partial time section corresponding to the wave part. Examples of such template data include a waveform template (WT) representative of a waveform shape in the partial time section, a pitch template (PT) representative of a pitch variation in the partial time section, an amplitude template (AT) representative of an amplitude variation in the partial time section, a spectrum template (ST) representative of a spectral variation in the partial time section, and a time template (TT) representative of a time-axial variation in the partial time section. As will be described later in detail, the user can edit a selected template as desired in order to create a new template, and also change a combination of templates constituting a particular wave part as desired in order to create a new wave part.

In performance, on the basis of input performance information made up of MIDI information and information indicative of a style of rendition therefor, a wave part having attributes closest to, or suiting, the input performance information is selected, so that wave parts corresponding to sequentially-input performance information are sequentially selected in accordance with the passage of time and thereby a tone corresponding to the performance information is generated by means of the tone generator section 21. In this way, it is possible to reproduce a performance capable of expressing articulation appearing as a reflection of a style of rendition and the like employed by the player.

Now, a description will be made about the wave parts and templates, with reference to FIGS. 2A and 2B which show exemplary screens displayed when they are subjected to editing processing. The user is allowed to graphically edit each of the wave parts and each of the templates for the corresponding wave part.

Figure 2B:
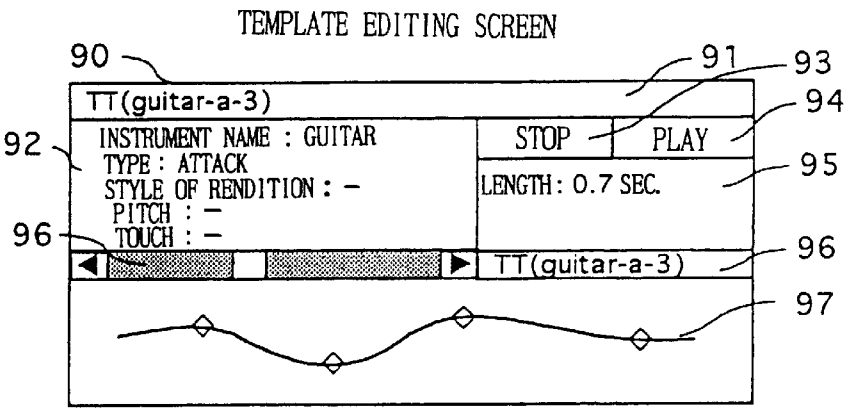
FIGS. 2A and 2B are diagrams showing examples of wave part editing and template editing screens displayed in the tone generation apparatus of FIG. 1.
Figure 2A:
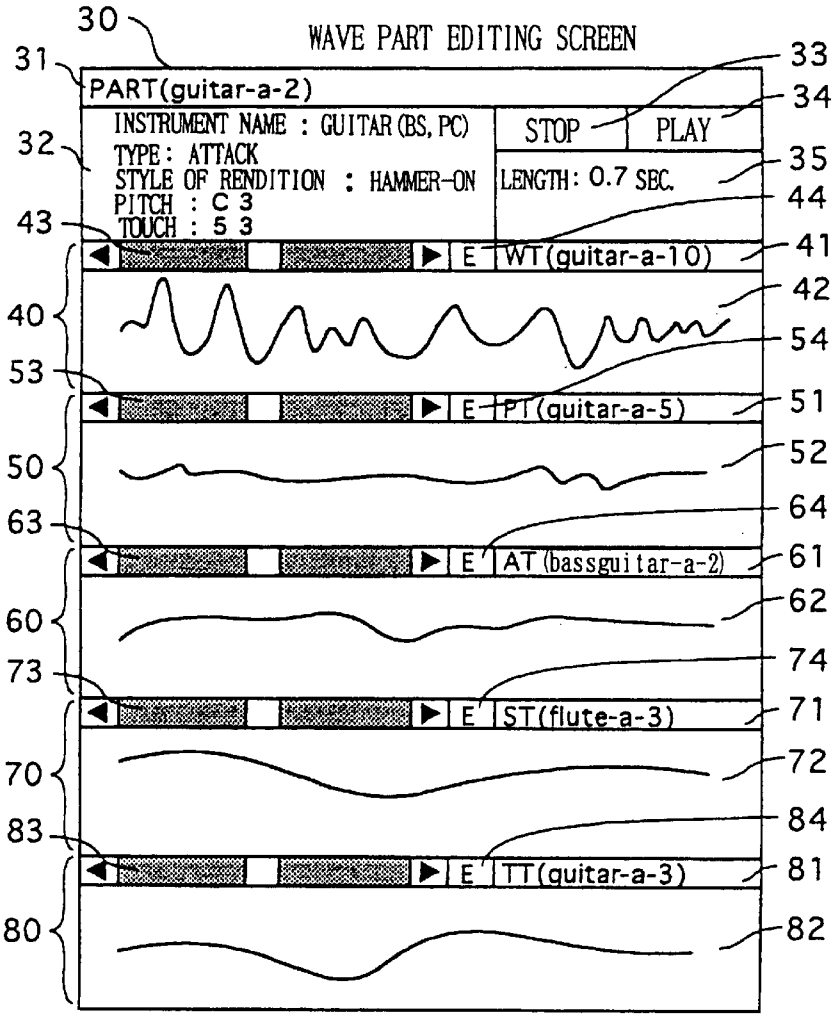

FIG. 2A shows a wave part window or wave part editing screen 30 displaying a wave part to be edited, which includes a wave part name display area 31 for showing the name of the wave part to be edited, a wave part attribute display area 32 for showing the attributes of the wave part, a play button 33 and stop button 34 for instructing a start and stop of reproduction of waveform data of the wave part, and a wave part time display area 35 for showing the reproduction time length of the waveform data of the wave part. In the illustrated example of FIG. 2A, a wave part name "guitar-a-2" is shown in the wave part name display area 31, from which it is seen that the wave part is that of an "attack portion" of a guitar tone.

As further illustrated, in the wave part attribute display area 32, there are shown the name of the musical instrument, type information indicating which of the attack, sustain and release portions the wave part corresponds to, information indicative of the style of rendition to which the wave part corresponds, information indicative of the pitch and touch of the wave part, etc. Here, examples of the information indicative of the style of rendition include hammer-on, pull-off, pitch bend, harmonics and tremolo in the case of a guitar, slur, tonguing, rapid rise, slow rise, trill in the case of a flute, and so on. To each of the style of renditions are imparted, as necessary, parameters indicative of characteristics thereof. For example, for tremolo, there are imparted parameters indicative of the cycle and depth of the tremolo etc., and for slur, there are imparted parameters indicative of a pitch variation curve, speed of the slur etc.

In the illustrated example of FIG. 2A, the musical instrument is "guitar", the type of the wave part is "attack portion", the style of rendition is "hammer-on", the pitch is "C3", and the touch is "53". Further, in the wave part time display area 35, the performance (reproduction) time length of this wave part is shown as "0.7 sec.".

By clicking the wave part name display area 31 via the mouse or the like, the user can edit the name of the wave part. Further, the user can edit the displayed contents in the wave part attribute display area 32 by clicking the attribute display area 32 via the mouse or the like. Furthermore, the user can edit the reproduction time length shown in the wave part time display area 35. Moreover, by activating the above-mentioned play button 33 and stop button 34 after editing the individual templates of the wave part in a later-described manner, the user can reproduce the resultant edited tone waveform of the wave part to thereby confirm the edited results.

Further, in FIG. 2A, reference numeral 40 denotes a waveform template display section for graphically showing a waveform template WT constituting the wave part. The waveform template display section 40 includes a name display area 41 for showing the name of the waveform template WT, a waveform display area 42 for graphically showing a variation in the shape of the waveform within the reproduction time (in this case, 0.7 sec.) of the wave part, a scroll bar 43 for changing the position of the waveform shown in the waveform display area 42 within the reproduction period, and an editing button ("E") 44 for shifting to a template editing mode when the user wants to edit the waveform template.

In the illustrated example of FIG. 2A, a waveform template name "WT (guitar-a-10)" is shown in the name display area 41, from which it is seen that the waveform template is a No. 10 waveform template for an attack portion of a guitar tone. By the user clicking the name display area 41 via the mouse and the like, a list of the names of all the waveform templates currently introduced or stored in the tone generation apparatus is displayed in such a way that the currently-selected waveform template can be replaced by another one newly selected by the user. In response to such selection by the user, the newly-selected waveform template can be read out and shown on the waveform template display section 40.

Further, in FIG. 2A, reference numeral 50 denotes a pitch template display section for graphically showing a pitch template PT constituting the wave part. Similarly to the above-mentioned waveform template display section 40, the pitch template display section 50 includes a name display area 51 for showing the name of the pitch template PT, a pitch display area 52 for graphically showing a variation in the pitch within the reproduction time of the wave part, a scroll bar 53 for controlling the position of the pitch variation shown in the pitch display area 52 within the reproduction period, and an editing button ("E") 54 for shifting to a template editing mode. In the illustrated example of FIG. 2A, a pitch template name "PT (guitar-a-5)" is shown in the name display area 51, from which it is seen that the pitch template is a No. 5 pitch template for an attack portion of a guitar tone. By the user clicking the name display area 51, the user is allowed to replace the currently-selected pitch template by another one, as with the waveform template.

Furthermore, in FIG. 2A, reference numeral 60 denotes an amplitude template display section for graphically showing an amplitude template AT constituting the wave part. Similarly to the above-mentioned waveform and pitch template display sections 40 and 50, the amplitude template display section 60 includes a name display area 61 for showing the name of the amplitude template AT, an amplitude display area 62 for graphically showing a variation in the amplitude within the reproduction time of the wave part, a scroll bar 63, and an editing button ("E") 64. In the illustrated example of FIG. 2A, an amplitude template name "AT(bassguitar-a-2)" is shown in the name display area 61, from which it is seen that the amplitude template is a No. 2 amplitude template for an attack portion of a bass guitar tone. By the user clicking the name display area 61, the user is allowed to replace the currently-selected amplitude template by another one of the amplitude templates introduced in the tone generation apparatus, as with the waveform and pitch templates.

Furthermore, in FIG. 2A, reference numeral 70 denotes a spectrum template display section for graphically showing a spectrum template ST constituting the wave part. Similarly to the above-mentioned template display sections 40, 50 and 60, the spectrum template display section 70 includes a name display area 71 for showing the name of the spectrum template ST, a spectrum display area 72 for graphically showing a variation in the spectrum within the reproduction time of the wave part, a scroll bar 73, and an editing button ("E") 74. By the user clicking the name display area 71, the user is allowed to replace the currently-selected spectrum template by another one of the spectrum templates introduced in the tone generation apparatus. In the illustrated example of FIG. 2A, a spectrum template name "ST(flute-a-3)" is shown in the name display area 71, from which it is seen that the spectrum template is a No. 3 spectrum template for an attack portion of a flute tone. As typically represented by this illustrated example, the present invention permits formation of various wave parts by freely combining desired ones of the templates without being bound by the type of the musical instrument. Note that each spectrum template ST is created by the user operating the editing button 74.

Moreover, in FIG. 2A, reference numeral 80 denotes a time template display section for graphically showing a time template TT constituting the wave part. Similarly to the above-mentioned template display sections 40, 50, 60 and 70, the time template display section 80 includes a time display area 81 for showing the name of the time template TT, a time display area 82 for graphically showing a time-axial variation within the reproduction time of the wave part, a scroll bar 83, and an editing button ("E") 84. Here, the time-axial variation is shown in the time display area 82 with the vertical axis representing a time compression rate and the horizontal axis representing the wave part's reproduction time. The higher the time compression rate, the shorter can be the reproduction time of a corresponding segment of the wave part. As mentioned above, each of the waveform template WT, pitch template PT, amplitude template AT and spectrum template ST represents a variation, over time, of waveform, pitch, amplitude or spectrum characteristics in the partial time section, and the time axial progression of all of these templates can be varied collectively by the characteristics of the time template TT.

In the illustrated example of FIG. 2A, a time template name "TT(guitar-a-3)" is shown in the name display area 81, from which it is seen that the time template is a No. 3 time template for an attack portion of a guitar tone. As with the other templates, the user is allowed to replace the currently-selected time template with another one by clicking the name display area 81. Note that the time template TT can also be created by the user, similarly to the spectrum template ST.

Now, a description will be made about editing of a selected one of the templates which is permitted by operating any one of the editing buttons 44, 54, 64, 74, 84 provided in the respective template display sections 40, 50, 60, 70 and 80.

Once any one of the editing buttons 44, 54, 64, 74, 84 of the template display sections 40, 50, 60, 70 and 80 is clicked by the user, a template editing screen 90 shows up as shown in FIG. 2B. The template editing screen 90 includes a wave part name display area 91 for showing the name of the template to be edited, a template attribute display area 92 for showing the attributes of the template, a play button 93 and stop button 94 for controlling reproduction of the template, and a time length display area 95 for showing the reproduction time length of the template. The template editing screen 90 also includes a template selection area 96 showing the name of the currently-selected template, and a template display area 97 showing the waveform of the template.

Specifically, in FIG. 2B, there is shown an example of a time template editing screen that is caused to show up when the editing button 84 for the time template TT is clicked on the wave part editing screen 30 of FIG. 2A, and a time template name "TT(guitar-a-3)" is shown in the name display section 90. The same template name "TT(guitar-a-3)" is also shown in the template selection area 96, and by the user clicking this template selection area 96, a list of all the other waveform templates currently introduced in the tone generation apparatus is displayed in such a way that the user can select and read out a desired one of the displayed waveform templates. Further, in the template display area 97, the waveform of the time template is shown along with quadrilateral editing points, so that the user can edit the template waveform into a desired waveform shape by dragging the editing points via the mouse or the like.

In this way, the user can create a new template by editing the displayed wave-part-constituting template as desired and also create a new wave part using the thus-created new template. As a result, an increased number of tone colors can be produced, by the present invention, using the already-existing (already-stored or already-introduced) templates without having to increase the necessary quantity of data. Further, new templates can be created by editing the already-existing templates and new wave parts can be created using the new templates, which also provides for production of a significantly increased variety of tones colors.

Next, with reference to FIG. 3, a description will be made as to how the above-mentioned wave parts and templates constituting the wave parts are stored and distributed. In the instant embodiment of the present invention, the data of the wave parts and templates are stored and distributed in two types of files, i.e. basic and subordinate or dependent files. Here, each of the basic files comprises a group of data that can be used singly, while each of the dependent files comprises a group of data capable of being used only when there is provided or prepared another file on which the group of data depends. Typically, it can be said that each of the basic files contains data of wave parts for generating a basic tone color and templates constituting the wave parts and each of the dependent files contains data of wave parts for generating a predetermined tone color and templates constituting the wave parts that are not contained in the basic files. Note that each of the basic and dependent files is stored with the data compressed.

The basic and dependent files are distributed to users via any of various media, such as a recording medium like a CD-ROM, communication network and wireless communication channel. Further, each of the users can edit each of the thus-distributed files in the above-described manner and store and distribute the edited file as a new basic or dependent file.

Figure 3A:
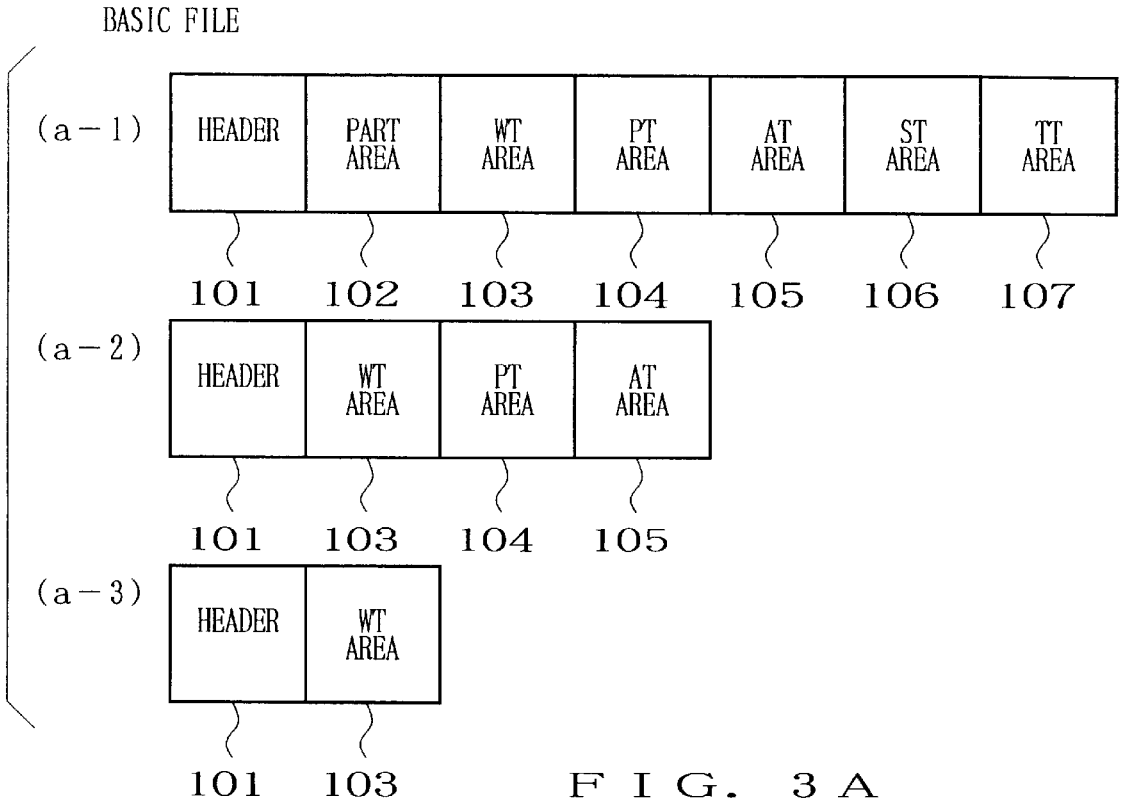
FIGS. 3A and 3B are diagrams showing several exemplary organizations of files containing tone generating data.

FIG. 3A is a diagram showing exemplary organizations of the basic file, in which (a-1) illustrates a most typical example of the organization.

As shown in (a-1) of FIG. 3A, the typical basic file is made up of a header portion 101, a wave part area 102, a waveform template (WT) area 103, a pitch template (PT) area 104, an amplitude template (AT) area 105, a spectrum template (ST) area 106, and a time template (TT) area 107.

In the illustrated example, the header portion 101 contains organization information indicating what kinds of information are contained in the file in question, file dependency information, permission information indicative of editing authority for (i.e., who has authorization to edit) the individual data contained in the file, copying authority information indicating whether or not and how many times the file can be copied, etc. If the file in question is a basic file, information indicating that the file has no other file to depend on is recorded as the file dependency information.

Further, the wave part area 102 is where is recorded wave part information pertaining to the individual wave parts contained in the file, and the wave part information for each of the wave parts includes information indicative of the name, attributes and reproduction time length of the wave part and information designating a combination of templates constituting the wave part (e.g., the names of the templates).

Each of the waveform template (WT) area 103, pitch template (PT) area 104, amplitude template (AT) area 105, spectrum template (ST) area 106 and time template (TT) area 107 is where collections of the templates constituting the individual wave parts are recorded on a type-by-basis; that is, the waveform template (WT) area 103 is where a collection of the waveform templates of the individual wave parts is recorded, the pitch template (PT) area 104 is where a collection of the pitch templates of the individual wave parts is recorded, and so on. Note that the contents or actual data of the various templates constituting the wave parts stored in the wave part area 102 are classified by the type of the template and the thus-classified contents are stored in the area 103–107, respectively.

The basic file may be organized in manners as shown in (a-2) and (a-3) of FIG. 3A, rather than being limited to the typical example shown in (a-1). That is, the basic file may be arranged to include only selected one or ones of the template areas with no wave part area, in which case the user edits or create a desired wave part using only the template(s) contained in the basic file.

Many of such basic files are generally supplied by parameters as basic data for creating a tone color, and set as "non-editable" and "non-copiable" files.

Figure 3B:
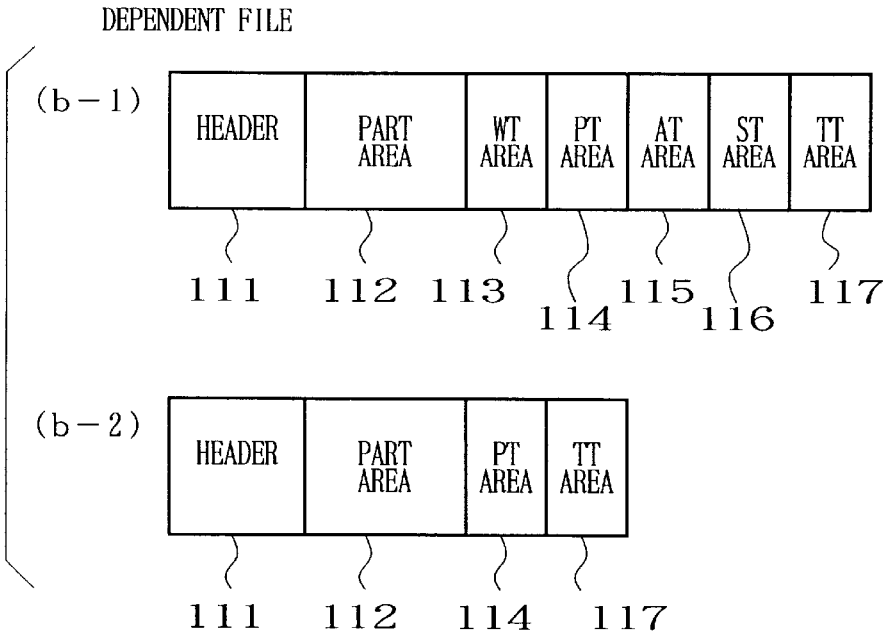

FIG. 3B is a diagram showing exemplary organizations of the dependent file. As shown, each of the dependent files is made up of a header portion 111, a wave part area 112, and a desired number of template areas (waveform template (WT) area 113, pitch template (PT) area 114, amplitude template (AT) area 115, spectrum template (ST) area 116 and time template (TT) area 117. These areas 111–117 are similar to the areas 101–107 of the basic file; however, the file dependency information stored in the header area 111 of each of the dependent files indicates the name of a particular basic file on which the dependent file depends. Further, the permission information and copying authority information of each of the dependent files can be set as desired by the user.

Further, each and every dependent file includes the wave part area 112, where, for each of the wave parts, information indicative of the name and attributes of the wave part and information designating templates constituting the wave part (e.g., the names of the templates) is stored similarly to the wave part area 102 of the basic file. Each of the templates constituting the individual wave parts recorded in this wave part area 112 is recorded in the template area of the basic file on which the dependent file in question depends as well as in the template area of the dependent file. In the case of such a template stored in the basic file on which the dependent file in question depends, the name of the template stored in the basic file is recorded. Accordingly, if the basic file on which the dependent file in question depends is not yet introduced in the tone generation apparatus, it is impossible to use the wave parts recorded in the wave part area 112 of the dependent file.

In the template areas 113–117, there are recorded such template data that are not stored in the basic file on which the dependent file in question depends.

Note that a certain one or ones of the dependent files may depend on a plurality of the basic files rather than just one basic file; in other words, each of the basic files may be depended on by a plurality of the dependent files.

Because the files employed in the instant embodiment of the present invention consist of the basic and dependent files and are arranged in such a manner that no template data are stored in a plurality of the files in a redundant or overlapping fashion as set out above, it is possible to reduce the necessary quantity of data.

Now, a detailed description will be made about processing for creating templates from the waveform data and the wave part editing processing which are performed in the instant embodiment.

Figure 4A:
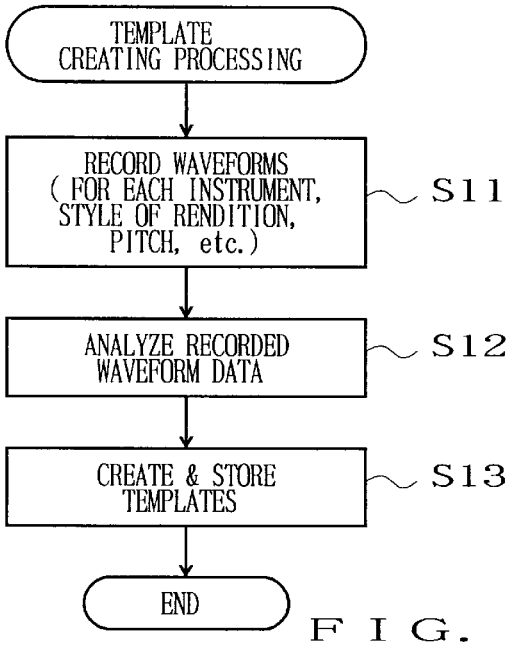
FIGS. 4A and 4B are flow charts showing exemplary operational sequences of template creating processing and wave part editing processing, respectively.

FIG. 4A is a flow chart showing an exemplary operational sequence of the template creating processing. First, at step S11, tone waveforms, providing bases of templates, are recorded in order to create templates from the waveforms; that is, a tone waveform is recorded for each musical instrument, for each style of rendition (performing technique), for each pitch, etc. The waveform data, recorded at this step S11 for each of the tones from the rise to fall thereof, are divided into attack, sustain, release and link portions, and operations of following steps S12 and S13 are carried out for each of the thus-divided portions. Therefore, templates ultimately created here will correspond to the divided portions.

At next step S12, the tone waveform data recorded at step S11 are analyzed. For example, data for creating a waveform template WT can be obtained by analyzing the recorded tone waveform itself, data for creating a pitch template PT can be obtained by extracting the pitch from the recorded tone, and data for creating an amplitude template AT can be obtained by analyzing the envelope of the recorded tone. Note that it is also possible to obtain data for creating a spectrum template ST by analyzing the spectrum of the recorded tone.

Then, the template creating processing proceeds to step S13, where different types of templates are created on the basis of the data representing the individual factors of the tone obtained through the analysis at step S12. Note that if a template to be created here is similar in shape to one of already-created templates, then creation of such a new template is not effected at this step to avoid wasteful duplication of the same template; namely, the instant embodiment permits shared use of the same template and thus can effectively save the limited storage capacity. Note that the similarity in the template shape may be determined by performing correlative arithmetic operations between the waveform data corresponding to one of the tone factors obtained through the analysis of step S12 and the waveform data of the already-existing templates (i.e., templates already introduced or registered in the tone generation apparatus) and judging those presenting a correlative value more than a predetermined threshold to be similar.

Figure 4B:
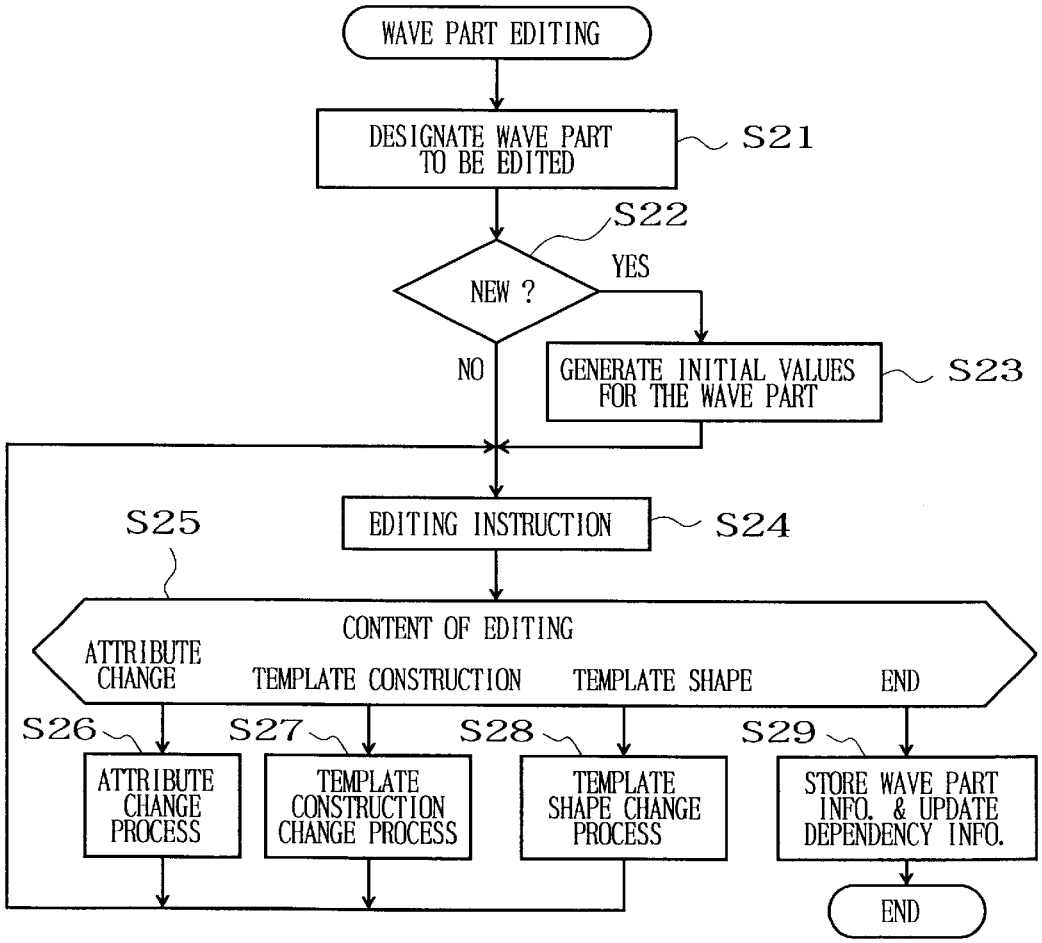

FIG. 4B is a flow chart showing an exemplary operational sequence of the wave part editing processing for, in accordance with instructions by the user, editing a new or already-existing wave part arranged as a combination of the templates created in the manner shown in FIG. 4A. This wave part editing processing is carried out using the wave part editing screen and template editing screen of FIGS. 2A and 2B.

First, at step S21, a particular wave part to be edited is designated. The wave part designation may be made by either just indicating that a new wave part is to be edited or specifying any one of the already-existing wave parts. Specifically, when any one of the already-existing wave parts is to be designated, the user may specify the name of a particular basic file or dependent file where the wave part is recorded as well as the name of the wave part. For example, when the user selects one of the basic and dependent files, a list of the wave parts recorded in the selected basic or dependent file is displayed, from which the user is allowed to select any desired one of the wave parts that is to be edited.

If it has been indicated that a new wave part is to be edited, then an affirmative (YES) determination is made at step S22, so that the template creating processing goes to step S23, where initial values for the new wave part are generated and a wave part editing screen 30 as shown in FIG. 2A is displayed with all information in blank.

If, on the other hand, one of the already-existing wave parts has been designated, corresponding wave part information and template data constituting the wave part are read out from the designated file and, as necessary, from another file on which the designated file depends, and these read-out information and data are shown on the wave part editing screen 30.

After that, the user gives an instruction for editing at step S24. Then, at next step S25, the content of the user's editing instruction is determined so that the processing branches to any one of several steps in accordance with the determined content of the editing instruction.

If the user's editing instruction is directed to changing the attributes of the wave part, i.e., if the user has clicked the wave part attribute display area 32 of the wave part editing screen 30 via the mouse or the like, the processing goes to step S26 for a wave part attribute change process. In the wave part attribute change process of step S26, the wave part attribute display area 32 is changed in its display color in such a manner that any one of various pieces of information, such as the name and type of the musical instrument and style of rendition, pitch and touch of the wave part, shown in the wave part attribute display area 32 can be edited by the user manipulating the character-inputting keyboard and the like.

If the user's editing instruction is directed to changing the template construction of the wave part, the processing goes to step S27 for a template construction change process. Namely, if the user has clicked any one of the template name display areas 41, 51, 61, 71 and 81 on the wave part editing screen 30, it is judged that the user has instructed execution of the template construction change process, and thus a list of all the templates of the designated type, currently introduced in the tone generation apparatus, is displayed as mentioned earlier. Once one of the displayed templates has been selected, the data of the selected template are read out from the corresponding file (basic or dependent file) and displayed in the corresponding template display section 40, 50, 60, 70 or 80 on the wave part editing screen 30.

Further, if the user's editing instruction is directed to changing the shape of one of the templates, i.e., if the user has clicked the editing button 44, 54, 64, 74 or 84 for one of the templates on the wave part editing screen 30 via the mouse or the like, the processing goes to step S28 to carry out a template shape change process. In the template shape change process of step S28, a template editing screen corresponding to the clicked editing button is opened as shown in FIG. 2B. Then, template editing processing is carried out in the manner as previously described in relation to FIG. 2B. Upon completion of the template editing processing, the edited template is stored in memory by the template shape change process of step S28. At that time, a determination is made as to whether there is any already-existing template that is similar in shape to the edited template. If there is such a similar already-existing template, the user is informed to that effect. For this purpose, correlative arithmetic operations may be performed sequentially between the shape of the edited template and the shapes of the already-existing templates, and if any one of the already-existing templates presents a correlative value more than a predetermined threshold, that already-existing template is informed to the user. Then, the user may either select the informed template as a template of the currently-edited wave part in place of the edited template or store the edited template as a new template with a new name. By thus employing the already-existing template similar to the edited template, the instant embodiment can reduce the quantity of data stored in memory. In the case where the edited template is to be stored as a new template, this template is stored into the corresponding template area of the dependent file.

Once the user instructs termination of the wave part editing processing after completion of the wave part attribute change process (step S26), template construction change process (step S27) or template shape change process (step S28), a termination process is performed at step S29. In the termination process, the edited wave part information is stored, and the file dependency information of the dependent file is updated; that is, the edited wave part information is written into the wave part area 112, and the file dependency information is written into the header area of the dependent file as necessary.

In the above-described manner, the wave part information can be edited. Because, as described above, the instant embodiment allows an already-existing template to be used in place of an edited template as long as the already-existing templates has predetermined similarity to the edited template, it is possible to prevent the file size from becoming unduly great.

Each of the thus-created files, such as the basic and dependent files supplied by the manufacture and other dependent files created and supplied by other users, can be distributed via any of various media, such as a recording medium like a CD-ROM or flexible disk and communication network, as noted earlier. To utilize the thus-distributed file, it is necessary to read (introduce) the file into the above-mentioned hard disk device or the like after decompressing the file as necessary, as will be described below with reference to FIG. 5.

Figure 5A:
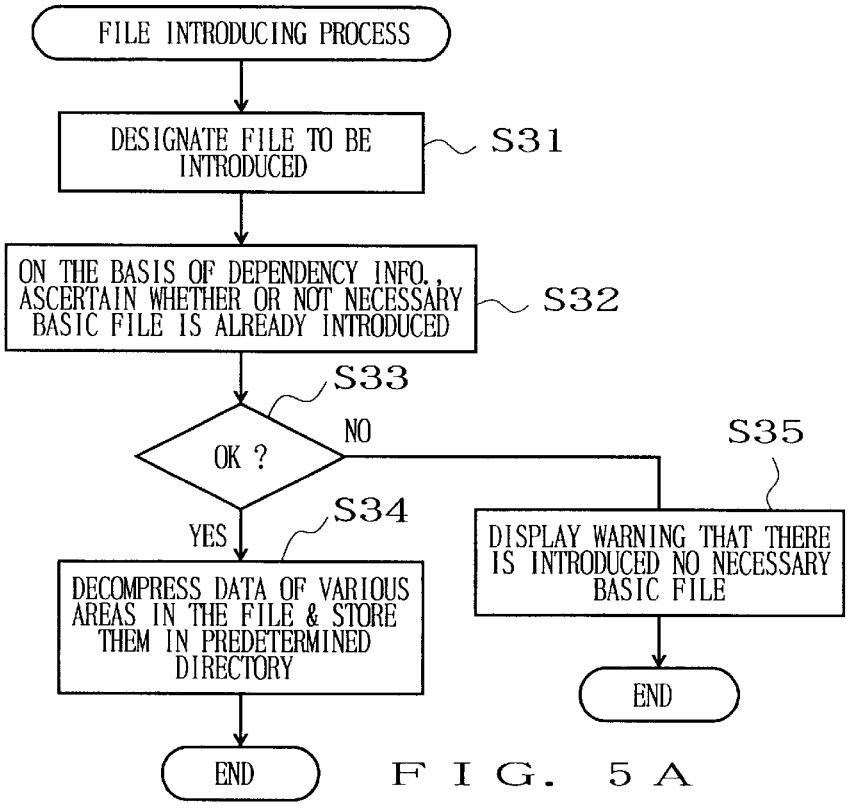
FIGS. 5A and 5B are flow charts showing exemplary operational sequences of a file introducing process and file canceling process, respectively.

FIG. 5A is a flow chart showing an exemplary operational sequence of a process for introducing a file. In the file introducing process, a particular file to be introduced is designated at step S31. Namely, a recording medium 18, such as a CD-ROM or MO disk, having basic or dependent files recorded thereon is inserted into the drive device 17, or basic or dependent files are read into the hard disk device 20 via a communication line. Thus, the files that can be introduced into the tone generation apparatus are shown to the user to allow the user to select therefrom any one of the files to be introduced. At this time, each file having already been introduced in the tone generation apparatus is displayed in a different display manner from that for the other files (e.g., in a lighter display) to indicate that the file is non-selectable. Further, if the file introducing process is executed for the first time, the instant embodiment creates file management information showing a list of all the already-introduced files.

At next step S32, the information stored in the header area of the user-designated file is read out, and it is ascertained, with reference to the file dependency information and above-mentioned file management information, whether or not the necessary basic file has already been introduced in the tone generation apparatus.

At step S33, it is further determined whether or not the necessary basic file has already been introduced in the tone generation apparatus as ascertained at step S32 or the designated file is a basic file. With an affirmative answer at step S33, the file introducing process proceeds to step S34, where the user-designated file is decompressed as necessary and the data of the individual areas in the file are stored into the hard disk. At this time, a directory is provided for each file, and a subdirectory is provided in the directory for each of the areas (part, waveform template, pitch template, amplitude template, spectrum template and time template areas).

If the necessary basic file is not introduced in the tone generation apparatus as ascertained at step S32, the file introducing process branches to step S35 in order to show a warning on the display section, in response to which the user introduces the basic file on which the dependent file to be introduced depends. With this arrangement, it is possible to prevent any dependent file from being introduced in a form unusable by the user.

Figure 5B:
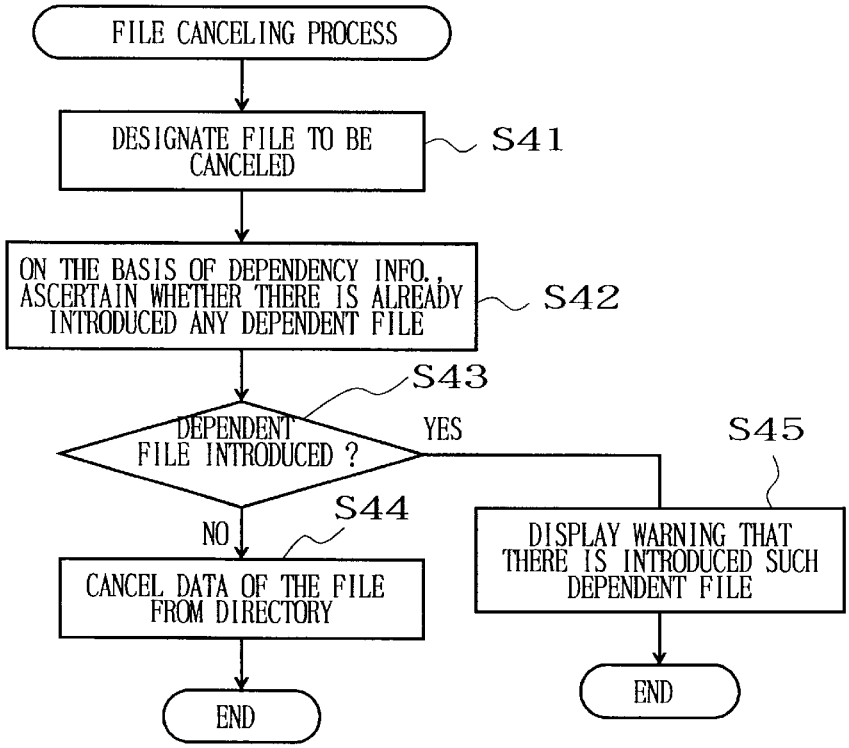

FIG. 5B is a flow chart showing an exemplary operational sequence of an file canceling process for removing or canceling an already-introduced file from the hard disk device 20. When an already-introduced file is to be canceled from the hard disk device 20, the file to be canceled is designated at step S41. The file designation is effected by showing, to the user, a list of all file names that can be canceled on the basis of the file management information so that the user selects one of the files to be canceled from among the listed file names.

At next step S42, it is ascertained, on the basis of the file dependency information of the file designated at step S41, whether or not there is already introduced any subordinate dependent file depending on the designated file. Then, if the dependent file is not yet introduced as determined at step S43, the file canceling process moves on to step S44, where all the data belonging to the user-designated file are deleted from the corresponding directory. If, on the other hand, the dependent file is introduced as determined at step S43, a warning to that effect is displayed at step S45, in response to which the user designates the dependent file to be canceled. In this way, in canceling the file, it is possible to prevent the user from inadvertently failing to cancel a file that can not be used singly.

Through the above-mentioned file introducing process, the user can introduce any desired basic and dependent files into the tone generation apparatus. As the desired files are introduced, directories of the individual files are provided in the hard disk device 20, subdirectories corresponding to the wave part area and template areas are provided in each of the directories, and the wave part information and various template information is read into the respective subdirectories.

Thus, when the desired files have been introduced, the user is allowed to execute the wave part editing processing in the above-described manner. Also, in actual performance, as will be later described, tones can be generated, by selecting, on the basis of MIDI information and information indicative of a style of rendition (performance information) and with reference to the attribute information of the individual wave parts stored in the wave part areas, particular wave parts having attribute information closest to the performance information and then supplying the tone generator section with the individual template data constituting the selected wave parts. Assuming that dependent files and basic files on which the dependent files depend are recorded on the hard disk 20, the instant embodiment selects the wave parts having attribute information closest to the performance information, by first searching the subdirectories of the wave part areas in the directories corresponding to the dependent files and then searching the subdirectories of the wave part areas in the directories corresponding to the basic files. In the case where the RAM 13 has a large-enough storage capacity, all the data of the wave part and template areas of each introduced file may be read into the RAM 13.

Finally, a description will be made about processing for generating a tone using the files created or edited in the above-mentioned manner, with reference to FIGS. 6A–6C.

Figure 6A:
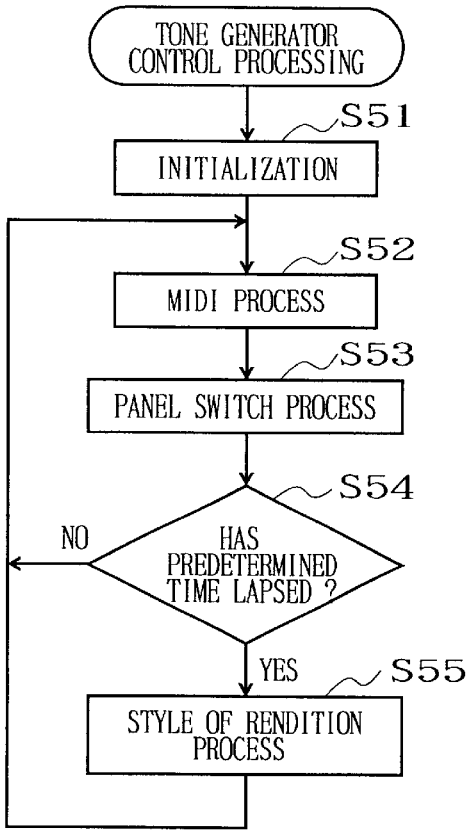
FIGS. 6A, 6B and 6C are flow charts showing exemplary operational sequences of tone generator control processing, style-of-rendition process and note-on event process, respectively.

FIG. 6A is a flow chart showing an exemplary operational sequence of tone generator control processing. Upon start of the tone generator control process, the tone generator and working area of the RAM 13 are set to predetermined initial condition at step S51. At next step S52, a MIDI process is performed which receives performance information, such as an SMF (Standard MIDI File), already stored in the MIDI interface circuit or hard disk device or a CD-ROM or other storage medium inserted in the drive device and then carries out processes corresponding to MIDI signals contained therein. For example, if the MIDI signal represents a note-on event, then a note-on event process is executed as will be later described in relation to FIG. 6C.

After that, the tone generator control processing proceeds to step S52 to perform a panel switch process. Namely, at step S52, a determination is made as to whether any operation has been made by the user via the input device 15 and, if so, a process corresponding to the user operation is carried out.

At following step S54, a determination is made as to whether or not a predetermined time has lapsed. If answered in the negative at step S54, the tone generator control processing loops back to step S52, but if predetermined time has lapsed as determined at step S54, the processing proceeds to a style-of-rendition process of step S55. Namely, the tone generator control processing is arranged to repetitively perform the processes corresponding to the MIDI events and user's operations on the panel and also perform the style-of-rendition process of step S55 each time the predetermined time lapses.

Figure 6B:
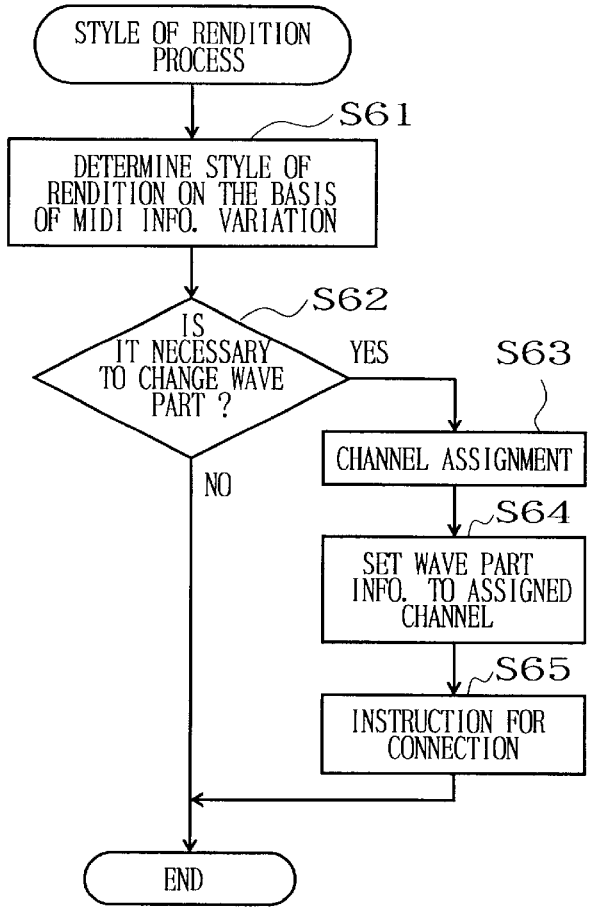

FIG. 6B is a flow chart showing an exemplary operational sequence of the style-of-rendition process of step S55. In this style-of-rendition process, the style of rendition employed is determined on the basis of the input MIDI signal, and in accordance with the determined style-of-rendition process, processes are performed for making a change to the wave parts to be used for generation of a tone and, when a change has been made to the wave parts, smoothly connecting the wave parts before and after the wave part change.

Upon start of the style-of-rendition process, a determination is made at step S61 as to what is the most suiting style of rendition, on the basis of a variation in the MIDI information processed via the above-mentioned MIDI process. For example, if the tone in question has a pitch shift as a pitch bend, the style of rendition employed is judged to be a bend style, if the tone has a pitch fluctuation of several herz as pitch bend, the style of rendition employed is judged to be a vibrato style, if a time interval from note-on timing to next note-off timing is 50% shorter than a time interval from the note-on timing to next note-on timing, the style of rendition employed is judged to be a staccato style, or if a note-on event overlaps a next note-on event, the style of rendition employed is judged to be a slur style.

Then, the style-of-rendition process proceeds to step S62 to compare the style of rendition determined at step S61 and the style of rendition contained in the attribute information of the currently-used wave part, in order to determine whether or not it is necessary to change the wave part to be used. For example, when a time corresponding to a wave part of the attack portion has lapsed from the note-on timing, there is a need to change from the wave part of the attack portion (its end segment) to a wave part of the sustain portion. Further, when a vibrato style is instructed at step S55 during the course of tone generation based on the wave part of the sustain portion with no particular style of rendition imparted thereto, there is a need to change from the wave part of the sustain portion to wave part of the sustain portion with a vibrato imparted thereto. Designation of a style of rendition may be made on the basis of a style-of-rendition code, indicative of a slur or staccato, embedded in automatic performance data of the standard MIDI file, in stead of via the style of rendition process of step S55.

If there is no need for a wave part change as determined at step S62, the style of rendition process is terminated without performing any other operation. If, on the other hand, there is a need for a wave part change as determined at step S62, then a tone generating channel is allocated to a new wave part (tone color) at step S63, and then new wave part information is set to the tone generating channel at step S64. Namely, various template information of the new wave part having been judged to be the closest is set to the tone generating channel of the tone generator section.

Then, at step S65, a connecting process is executed for smoothly connecting the tone based on the currently-used wave part and the tone based on the new wave part. This connection is achieved by cross-fade connecting the tone generating channel of the currently-sounded wave part and the tone generating channel having been set at step S64. In this manner, the style of rendition process is executed at predetermined time intervals to provide for smooth wave part changes.

Figure 6C:
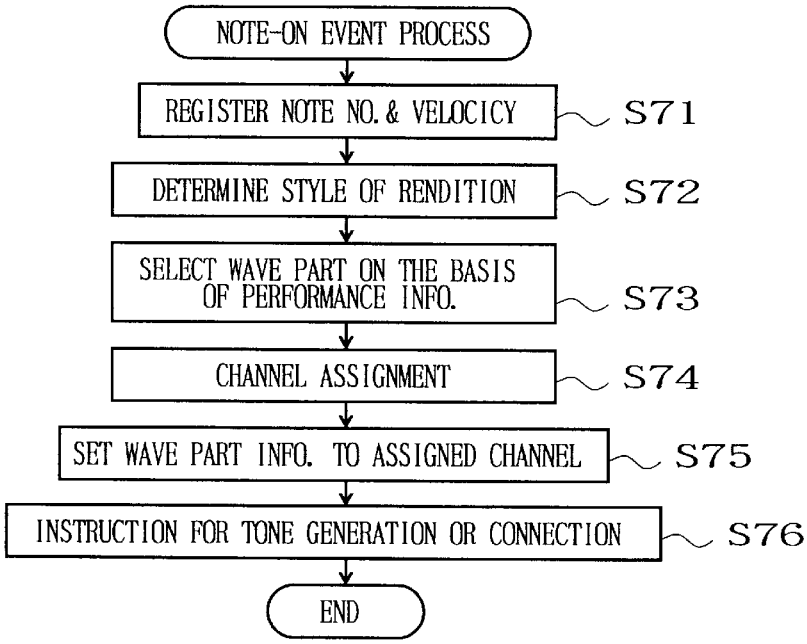

FIG. 6C is a flow chart showing an exemplary operational sequence of a note-on event process performed when a note-on event is detected from the MIDI signals. Once a note-on event is detected, the note number and velocity data of the note-on event are registered at step S71, and a style-of-rendition determining process is carried out at step S72 to determine a style of rendition using the determination result of the above-described style of rendition process of step S55, or using the automatic performance information of the SMF and style-of-rendition information previously imparted on the basis of a style-of-rendition indicating sign recorded on a musical score. Note that the note number and velocity data registered at step S71 and information indicative of the style-of-rendition determined at step S72 will hereinafter be referred to collectively as performance information.

Then, the note-on event process proceeds to step S73, where a specific wave part having attribute information most closely suiting the performance information is selected. Namely, reference is made to the attribute information of the individual wave parts contained in the currently-selected tone color on the basis of the style-of-rendition information obtained by step S72, so that a specific wave part having the closest attribute information is selected as a wave part to be sounded. As explained earlier in relation to FIG. 2A, the attribute information of each of the wave parts includes information pertaining to the style of rendition of the wave part and parameters indicative of characteristics of the style of rendition. The wave part most closely suiting the performance information is selected using these information.

Then, at step S74, a tone generating channel is assigned to the wave part selected at step S73. At next step S75, the waveform data of the individual templates of the selected wave part are set, as control parameters, to the assigned tone generating channel. For example, the waveform data of the waveform template WT is set as an output of the waveform memory, the waveform data of the pitch template PT as pitch modifying data, the waveform data of the amplitude template AT as an amplitude envelope, and the waveform data of the spectrum template ST as a tone color filter coefficient. At this time, the waveform of the time template TT is used for controlling timing (time axis) when the respective waveforms of the above-mentioned waveform template WT, pitch template PT, amplitude template AT and spectrum template ST are supplied to the tone generator section every sampling timing. Also, if there is a difference in parameter characteristics between the attribute information of the wave part selected at step S72 and the performance information, the above-mentioned control parameters are adjusted in accordance with the difference.

At following step S76, a tone generating instruction is given to the assigned tone generating channel if the style of rendition determined at step S72 is a normal one, or if the style of rendition determined at step S72 is one for connecting two successive tones such as a slur or portamento, an instruction is given to the assigned tone generating channel for connecting with another tone generating channel having so far engaged in tone generation.

In the above-described manner, the instant embodiment of the present invention can generate a tone on the basis of SMF or other automatic performance information and using various wave parts of the tone.

Further, as described above, the instant embodiment of the present invention is arranged to determine, in real time, a style of rendition (i.e., performing technique) from MIDI or other performance data, select wave parts on the basis of the determined style of rendition and then generate a tone based on the selected wave parts. Thus, even with performance data where no style of rendition is instructed, it is possible to generate a tone corresponding to some style of rendition while determining a style of rendition in real time.

Furthermore, in the case where a style-of-rendition designating code is embedded in MIDI or other performance data, the instant embodiment selects wave parts in accordance with the style-of-rendition designating code to thereby generate a tone. Therefore, a style-of-rendition-imparted tone can be generated in correspondence with the style-of-rendition designating code embedded at optionally-selected timing within the performance data sequence.

Besides, because the instant embodiment is arranged to perform a combination of the above-mentioned two tone generating schemes, it can generate tones based on both the style of rendition determined from the performance data sequence and the style of rendition corresponding to the style-of-rendition designating code embedded in the performance data.

Moreover, whereas the instant embodiment has been described above as managing file-by-file dependency by the file dependency information, it may have dependency information for each of the wave parts indicating which of the files the wave part depends on. In another alternative, unique identification data (ID) may be imparted to each of the templates and each of the wave parts may have, as dependency information, the identification data of the individual templates belonging thereto.

In addition, the instant embodiment may be arranged such that a group of wave parts introduced as a dependent file can be re-stored as a basic file containing necessary templates. Note that the re-storage can be effected only when it is permitted by the copy authority information.

In summary, the tone generation method of the present invention is characterized by producing any desired tone color by combining a plurality of wave parts, and thus can increase variations of tone colors with a smaller quantity of data.

Further, the tone generation method of the present invention is characterized by making a desired wave part by combining a plurality of templates and allowing the templates to be shared between the wave parts. Therefore, by combining the templates, the present invention can increase variations of tone colors with a smaller quantity of data, and thus can generate tones of an increased number of tone colors with a reduced quantity of data.

Furthermore, with the arrangement that a tone is generated by selecting wave parts in accordance with performance information and interconnecting the selected wave parts, the present invention can generate tones much richer in expression as compared to tones generated by the conventional waveform-memory-based tone generators. Moreover, in the present invention, wave parts are selected on the basis of a distance or difference between wave-part-corresponding performance information and input performance information, so that there is no need to prepare wave parts for all values of the input performance information and thus it is possible to reduce the number of the wave parts to be stored. Besides, a tone can be generated even when performance information with no corresponding wave parts is input.

Further, according to the tone-generating-data recording method of the present invention, the user is allowed to create a new tone color by freely combining a plurality of templates, and a new template is created only when a desired tone can not be produced with already-existing templates alone. Accordingly, a desired new tone color can be created, without substantially increasing the necessary data quantity, by just editing within the range of the template combinations. Besides, when a template is edited, the edited template is recorded only if it differs in shape from already-recorded templates, which can effectively minimize an increase in the data quantity.

Finally, according to the tone-generating-data recording method of the present invention, dependency information is recorded, for each tone color, which is indicative of dependency of the tone color on another tone color, and the tone color can be used only in the case where there is prepared such another tone color which it depends on. In the case where dependency information is recorded, for each tone color, which is indicative of dependency of the tone color on another tone color, and if there is prepared no other tone color which the tone color depends on, the user is informed to that effect so that a tone intended by a creator of wave parts can be reliably reproduced.

What is claimed is:

1. A tone generation method for generating tone waveform data on the basis of given performance information, said tone generation method comprising:

a step of selecting wave part data suiting the given performance information from among wave part data that are to be used for generating tone waveform data corresponding to a partial time section of a tone, the wave part data designating a combination of template data indicative of respective variations of a plurality of tone factors in the partial time section; and a step of using the wave part data selected by said step of selecting to generate tone waveform data corresponding to the partial time section of the tone, the tone waveform data corresponding to the partial time section of the tone being generated on the basis of respective template data for the plurality of tone factors contained in the wave part data.

2. A management method for use in a system for generating tone waveform data, said management method comprising:

a step of introducing a tone generating data file into said system for generation of tone waveform data, the tone generating data file being at least one of first-type and second-type tone generating data files;

said first-type tone generating data file including:

wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section, said second-type tone generating data file including:

said wave part data;

information instructing that template data present in a predetermined other tone generating data file should be used for at least one template data of the set of the template data designated by the wave part data; and remaining template data of the set of the template data designated by the wave part data;

a step of, when said second-type tone generating data file is introduced into said system by said step of introducing, determining whether or not the predetermined other tone generating data file is already introduced in said system; and a step of issuing a predetermined warning when it has been determined that the predetermined other tone generating data file is not yet introduced in said system.

3. A management method for use in a system for generating tone waveform data, said management method comprising:

a step of canceling, from said system, a tone generating data file having been present so far in said system for use for tone waveform data generation, the tone generating data file being at least one of first-type and second-type tone generating data files;

said first-type tone generating data file including:

wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section, said second-type tone generating data file including:

said wave part data;

information instructing that template data present in a predetermined other tone generating data file should be used for at least one template data of the set of the template data designated by the wave part data; and remaining template data of the set of the template data designated by the wave part data;

a step of determining whether or not the tone generating data file to be canceled by said step of canceling is the predetermined other tone generating data file to be used by said second-type tone generating data file and said second-type tone generating data file using the predetermined other tone generating data file is already introduced in said system; and a step of issuing a predetermined warning prior to cancellation of the tone generating data file from said system, when an affirmative determination has been made in said step of determining.

4. A method for storing tone generating data wherein the tone generating data comprises a tone generating data file that includes wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section, said method comprising:

a step of editing template data of an already-existing tone generating data file and creating new wave part data based on the already-existing tone generating data file; and a step of storing the new wave part data and template data created and edited by said step of editing as a new tone generating data file distinct from the already-existing tone generating data file.

5. A method for storing tone generating data wherein the tone generating data comprises a tone generating data file that includes wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section, said method comprising:

a step of creating new template data;

a step of determining whether or not template data similar to the new template data created by said step of creating is present in any already-existing tone generating data file; and a step of, when it has been determined that template data similar to the new template data is present in an already-existing tone generating data file, performing control to store information instructing that the template data similar to the new template data present in the already-existing tone generating data file should be used in place of the new template data, without storing the new template data as created.

6. A method as claimed in claim 5 wherein said step of creating new template data creates new template data by editing template data of an already-existing tone generating data file.

7. A method for generating tones by using a machine-readable medium having tone generating data to be used for generating tone waveform data that corresponds to a partial time section of a tone, said tone generating data including at least one wave part data designating a combination of template data that are indicative of respective variations of a plurality of tone factors in the partial time section and template data designated by the wave part data, said wave part data including attribute information comprising: a name of a musical instrument to which the wave part corresponds, a type of the partial time section, a style of rendition, pitch and touch of the partial time section, and information designating the template data constituting the wave part, said tone generating method comprising the steps of:

selecting, from among wave part data included by said tone generating data, a wave part data corresponding to a given performance information from among wave part; and using the selected wave part data to generate tone waveform data corresponding to the partial time section of the tone, wherein the generated tone waveform data corresponds to the partial time section of the tone on the basis of respective template data for the plurality of tone factors designated by the wave part data.

8. A tone generation apparatus for generating tone waveform data on the basis of given performance information, said tone generation apparatus comprising:

a memory storing a plurality of wave part data to be used for generating tone waveform data corresponding to a partial time section of a tone, each of the wave part data including data designating a combination of template data that are indicative of respective variations of a plurality of tone factors in the partial time section; and a processor coupled with said memory, said processor being adapted to:

select wave part data suiting the given performance information from said memory; and use the selected wave part data to generate tone waveform data corresponding to the partial time section of the tone, on the basis of respective template data for the plurality of tone factors contained in the wave part data.

9. A system for generating tone waveform data comprising:

a memory storing tone generating data files to be used for generating tone waveform data, said tone generating data files including at least first-type and second-type tone generating data files, said first-type tone generating data file including:

wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section, said second-type tone generating data file including:

said wave part data;

information instructing that template data present in a predetermined other tone generating data file should be used for at least one template data of the set of the template data designated by the wave part data; and remaining template data of the set of the template data designated by the wave part data;

an input device adapted to introduce a tone generating data file into said system;

a display adapted to issue a visual or audible or moving warning display; and a processor coupled with said memory, said input device and said display, said processor being adapted to:

introduce a tone generating data file into said system via said input device;

determine, when the tone generating data file introduced via said input device is said second-type tone generating data file, whether or not the predetermined other tone generating data file is already stored in said memory; and cause said display to issue a predetermined warning display when it has been determined that the predetermined other tone generating data file is not yet stored in said memory.

10. A system for generating tone waveform data comprising:

a memory storing tone generating data files to be used for generating tone waveform data, said tone generating data files including at least first-type and second-type tone generating data files, said first-type tone generating data file including:

wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section, said second-type tone generating data file including:

said wave part data;

information instructing that template data present in a predetermined other tone generating data file should be used for at least one template data of the set of the template data designated by the wave part data; and remaining template data of the set of the template data designated by the wave part data;

a display adapted to issue a visual or audible or moving warning display; and a processor coupled with said memory and said display, said processor being adapted to:

cancel a selected tone generating data file from said memory;

determine whether or not the tone generating data file to be canceled is the predetermined other tone generating data file to be used by said second-type tone generating data file and said second-type tone generating data file using the predetermined other tone generating data file is already stored in said memory; and issue a predetermined warning prior to cancellation of the selected tone generating data file from said memory, when it has been determined that the tone generating data file to be canceled is the predetermined other tone generating data file and said second-type tone generating data file using the predetermined other tone generating data file is already stored in said memory.

11. A control apparatus including a processor and a memory for storing tone generating data wherein the tone generating data comprises a tone generating data file that includes wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section, said processor being operatively coupled with said memory and being adapted to:

edit template data of a tone generating data file already stored in said memory and create new wave part data based on the already-stored tone generating data file; and store the created new wave part data and the edited template data as a new tone generating data file distinct from the tone generating data file already stored in said memory.

12. A control apparatus including a processor and a memory for storing tone generating data wherein the tone generating data comprises a tone generating data file that includes a wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section, said processor being operatively coupled with said memory and being adapted to:

create new template data;

determine whether or not template data similar to the created new template data is present in any tone generating data file already stored in said memory; and perform control, when it has been determined that template data similar to the new template data is present in a tone generating data file already stored in said memory, to store information instructing that the template data similar to the new template data present in the already-stored tone generating data file should be used in the place of the new template data, without storing the new template data as created.

13. A machine-readable storage medium containing a group of instructions to cause said machine to implement a tone generation method for generating tone waveform data on the basis of given performance information, said tone generation method comprising:

a step of selecting wave part data suiting the given performance information from among wave part data that are to be used for generating tone waveform data corresponding to a partial time section of a tone, the wave part data designating a combination of template data indicative of respective variations of a plurality of tone factors in the partial time section; and a step of using the wave part data selected by said step of selecting to generate tone waveform data corresponding to the partial time section of the tone, the tone waveform data corresponding to the partial time section of the tone being generated on the basis of respective template data for the plurality of tone factors contained in the wave part data.

14. A machine-readable storage medium containing a group of instructions to cause said machine to implement a management method for use in a system for generating tone waveform data, said management method comprising:

a step of introducing a tone generating data file into said system for generation of tone waveform data, the tone generating data file being at least one of first-type and second-type tone generating data files;

said first-type tone generating data file including:

wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section, said second-type tone generating data file including:

said wave part data;

information instructing that template data present in a predetermined other tone generating data file should be used for at least one template data of the set of the template data designated by the wave part data; and remaining template data of the set of the template data designated by the wave part data;

a step of, when said second-type tone generating data file is introduced into said system by said step of introducing, determining whether or not the predetermined other tone generating data file is already introduced in said system; and a step of issuing a predetermined warning when it has been determined that the predetermined other tone generating data file is not yet introduced in said system.

15. A machine-readable storage medium containing a group of instructions to cause said machine to implement a management method for use in a system for generating tone waveform data, said management method comprising:

a step of canceling, from said system, a tone generating data file having been present so far in said system for use for tone waveform data generation, the tone generating data file being at least one of first-type and second-type tone generating data files;

said first-type tone generating data file including:

wave part data for generating tone waveform data corresponding to a partial time section of a tone, the wave part data including data designating template data that are indicative of respective variations of a plurality of tone factors in the partial time section; and a set of the template data designated by the wave part data and indicative of the respective variations of the plurality of tone factors in the partial time section, said second-type tone generating data file including:

said wave part data;

information instructing that template data present in a predetermined other tone generating data file should be used for at least one template data of the set of the template data designated by the wave part data; and remaining template data of the set of the template data designated by the wave part data;

a step of determining whether or not the tone generating data file to be canceled by said step of canceling is the predetermined other tone generating data file to be used by said second-type tone generating data file and said second-type tone generating data file using the predetermined other tone generating data file is already introduced in said system; and a step of issuing a predetermined warning prior to cancellation of the tone generating data file from said system, when an affirmative determination has been made in said step of determining.

16. A machine-readable storage medium containing a group of instructions to cause said machine to implement a method for storing tone generating data wherein the tone generating data comprises a tone generating data file that includes wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section, said method comprising:

a step of editing template data of an already-existing tone generating data file and creating new wave part data based on the already-existing tone generating data file; and a step of storing the new wave part data and template data created and edited by said step of editing as a new tone generating data file distinct from the already-existing tone generating data file.

17. A machine-readable storage medium containing a group of instructions to cause said machine to implement a method for storing tone generating data wherein the tone generating data comprises a tone generating data file that includes wave part data to be used for generating tone waveform data corresponding to a partial time section of a tone, the wave part data including data designating template data that are indicative of respective variations of a plurality of tone factors in the partial time section, and a set of the template data designated by the wave part data and indicative of the respective variations of the plurality of tone factors in the partial time section, said method comprising:

a step of creating new template data;

a step of determining whether or not template data similar to the new template data created by said step of creating is present in any already-existing tone generating data file; and a step of, when it has been determined that template data similar to the new template data is present in an already-existing tone generating data file, perform control to store information instructing that the template data similar to the new template data present in the already-existing tone generating data file should be used in place of the new template data, without storing the new template data as created.

* * * * *